US012660963B2

(12) United States Patent
Jones Turnbough

(10) Patent No.: US 12,660,963 B2
(45) Date of Patent: Jun. 23, 2026

(54) BATHING SEATING ASSEMBLY AND METHOD OF USE

(71) Applicant: Gladys Jones Turnbough, Aurora, CO (US)

(72) Inventor: Gladys Jones Turnbough, Aurora, CO (US)

( * ) Notice: Subject to any disclaimer, the term of this patent is extended or adjusted under 35 U.S.C. 154(b) by 0 days.

(21) Appl. No.: 18/088,098

(22) Filed: Dec. 23, 2022

(65) Prior Publication Data

US 2024/0206685 A1 Jun. 27, 2024

(51) Int. Cl.
*A47K 3/12* (2006.01)

(52) U.S. Cl.
CPC ..... *A47K 3/122* (2013.01)

(58) Field of Classification Search
CPC ..... A47K 3/122
See application file for complete search history.

(56) References Cited

U.S. PATENT DOCUMENTS

| | | | | |
|---|---|---|---|---|
| 5,465,437 | A | 11/1995 | Herman | |
| 6,122,776 | A | 9/2000 | Cheng | |
| 6,997,512 | B1 | 2/2006 | Yu | |
| 7,159,940 | B1 | 1/2007 | Atkins | |
| D666,435 | S * | 9/2012 | Meyers | D6/716 |
| 9,095,483 | B2 * | 8/2015 | Storm | A61G 5/1002 |
| 9,763,545 | B2 * | 9/2017 | Liu | A47K 3/122 |
| 10,405,887 | B2 * | 9/2019 | Davia | A61M 35/003 |
| D867,779 | S | 11/2019 | Chang | |
| 10,595,682 | B2 * | 3/2020 | Racanelli | A47K 3/282 |
| 10,736,470 | B2 * | 8/2020 | Preece | A47C 13/005 |
| 11,589,716 | B2 * | 2/2023 | Birdsong | A47K 3/122 |
| 2003/0000039 | A1 * | 1/2003 | Borcherds | A47K 7/028 53/473 |
| 2004/0070238 | A1 | 4/2004 | Moser | |
| 2005/0132485 | A1 | 6/2005 | Buggs | |
| 2009/0193576 | A1 * | 8/2009 | Hsiao | A47K 3/122 4/578.1 |
| 2017/0367540 | A1 * | 12/2017 | Chang | A47K 3/122 |
| 2020/0022536 | A1 * | 1/2020 | Malassigné | A47K 3/122 |

FOREIGN PATENT DOCUMENTS

| | | |
|---|---|---|
| WO | WO0008990 | 2/2000 |

* cited by examiner

*Primary Examiner* — Christine J Skubinna

(57) ABSTRACT

A bathing seating assembly for facilitating washing of one's genitalia and anal region includes a panel, which substantially rigid. A plurality of legs is attached to and extends from a lower face of the panel. A pair of cutouts is positioned in the panel and extend singly into a front edge and a rear edge of the panel. Each cutout is positioned substantially equally distant from opposed side edges of the panel. The legs support the panel above a surface of a bathing enclosure, such as that for a tub or shower. A user can sit upon the upper face of the panel with their genitalia and anal region being accessible for bathing via the cutouts in the front edge and the rear edge, respectively. A plurality of orifices that is positioned in the panel drains water from the upper face.

20 Claims, 8 Drawing Sheets

BATHING SEATING ASSEMBLY AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bathing seating assemblies and more particularly pertains to a new bathing seating assembly for facilitating washing of one's genitalia and anal region. The present invention discloses a seating assembly having a holed seat in which a pair of cutouts are opposingly positioned to allow for bathing of one's genitalia and anal region.

(2) Description of Related Art Including Information Disclosed Under 37 CFR 1.97 and 1.98

The prior art relates to bathing seating assemblies, which may comprise seating assemblies having swiveling seats attached to articulating arms extending from floors of bathing enclosures, bathing chairs having holed seats for drainage, some of which incorporate bidets, and stools with cushioned seats that rotate. Related prior art comprises eccentrically swiveling seats for use at tables and chairs having a large hole and which can be positioned over a toilet. What is lacking in the prior art is a seating assembly for use in a bathing enclosure that comprises a holed seat in which a pair of cutouts are opposingly positioned to allow for bathing of one's genitalia and anal region. Further lacking in the prior art is such a seating assembly that is configured as a stool and wherein the holed seat is configured for swiveling or rotating.

BRIEF SUMMARY OF THE INVENTION

An embodiment of the disclosure meets the needs presented above by generally comprising a panel, which substantially rigid. A plurality of legs is attached to and extends from a lower face of the panel. A pair of cutouts is positioned in the panel and extend singly into a front edge and a rear edge of the panel. Each cutout is positioned substantially equally distant from opposed side edges of the panel. The legs are configured to support the panel above a surface of a bathing enclosure, such as that for a tub or shower. An upper face of the panel is configured so as to seat a user, with genitalia and an anal region of the user being accessible for bathing via the cutouts in the front edge and the rear edge, respectively. A plurality of orifices is positioned in the panel and is configured to drain water from the upper face.

Another embodiment of the disclosure includes a method of bathing one's genitalia and anal region. The method comprises a provision step, which entails providing a bathing seating assembly, as per the disclosure above. Operational steps are positioning the bathing seating assembly on a surface in a bathing enclosure and adjusting the legs to substantially level the panel. Use steps are sitting upon the panel and washing one's genitalia and anal region.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
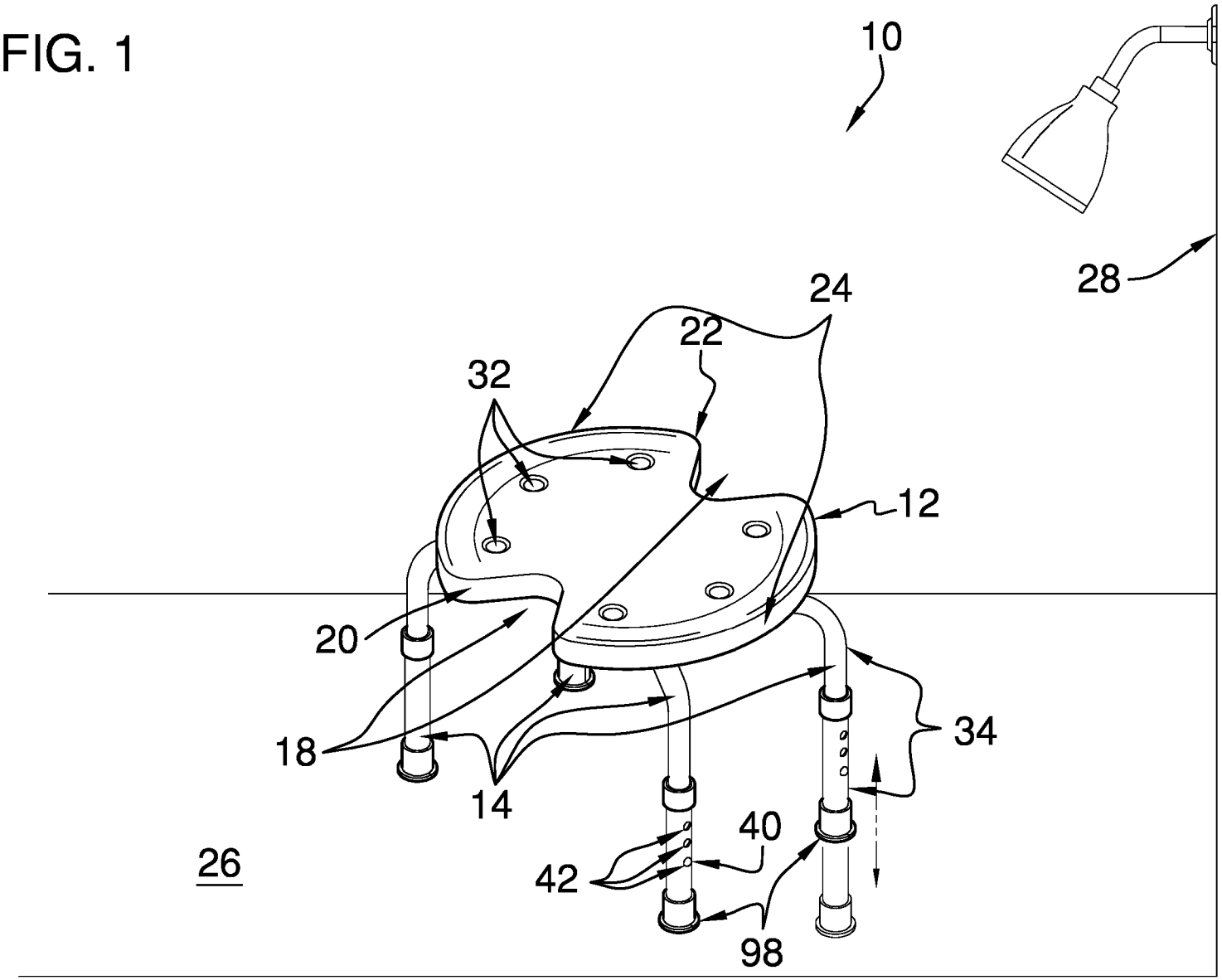
FIG. 1 is an in use view of a bathing seating assembly according to an embodiment of the disclosure.

With reference now to the drawings, and in particular to FIGS. 1 through 8 thereof, a new bathing seating assembly embodying the principles and concepts of an embodiment of the disclosure and generally designated by the reference numeral 10 will be described.

As best illustrated in FIGS. 1 through 8, the bathing seating assembly 10 generally comprises a panel 12, which substantially rigid. A plurality of legs 14 is attached to and extends from a lower face 16 of the panel 12. A pair of cutouts 18 is positioned in the panel 12 and extend singly into a front edge 20 and a rear edge 22 of the panel 12. Each cutout 18 is positioned substantially equally distant from opposed side edges 24 of the panel 12. The legs 14 are configured to support the panel 12 above a surface 26 of a bathing enclosure 28, such as a tub or shower. An upper face 30 of the panel 12 is configured so as to seat a user, with genitalia and an anal region of the user being accessible for bathing via the cutouts 18 in the front edge 20 and the rear edge 22, respectively. A plurality of orifices 32 is positioned in the panel 12 and is configured to drain water from the upper face 30.

Figure 2:
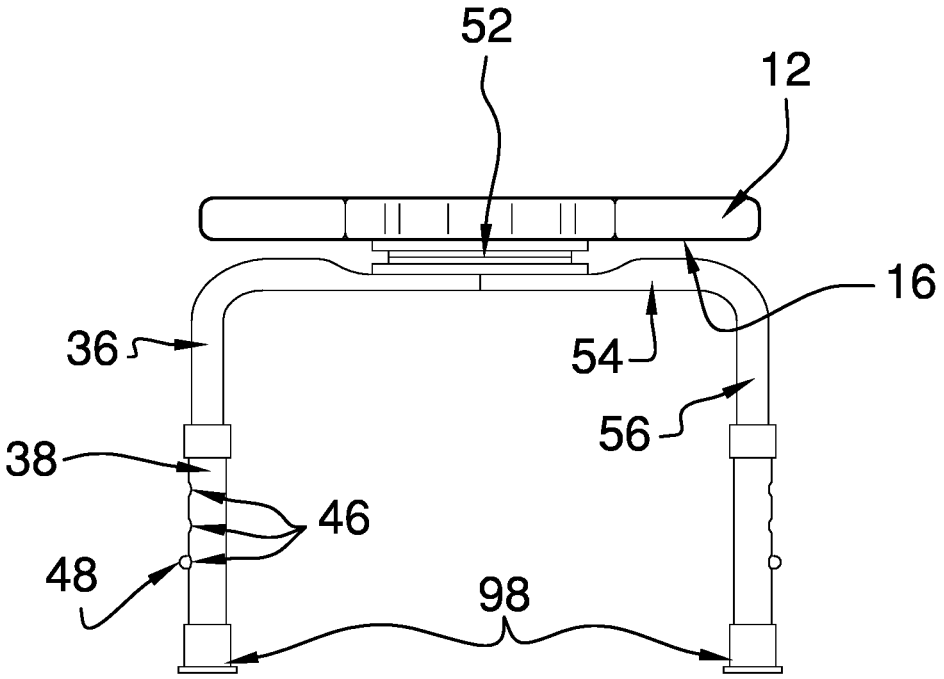
FIG. 2 is a front view of an embodiment of the disclosure.
Figure 3:
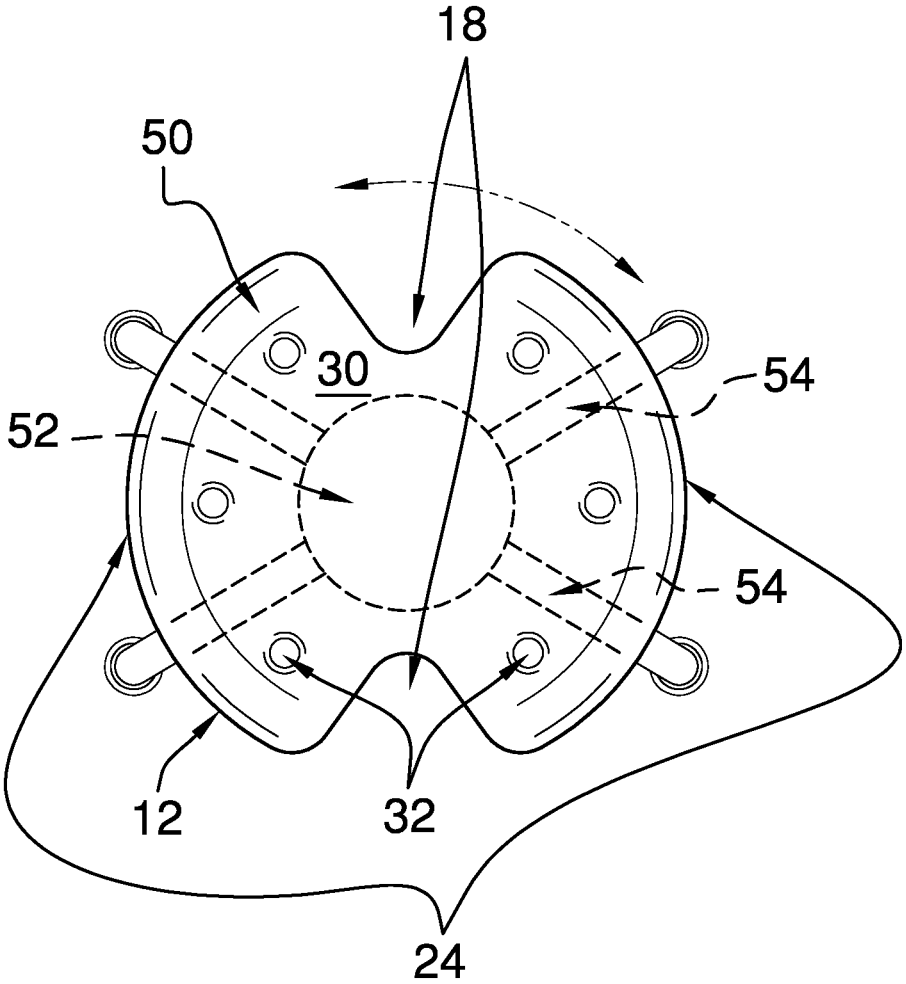
FIG. 3 is a top view of an embodiment of the disclosure.
Figure 4:
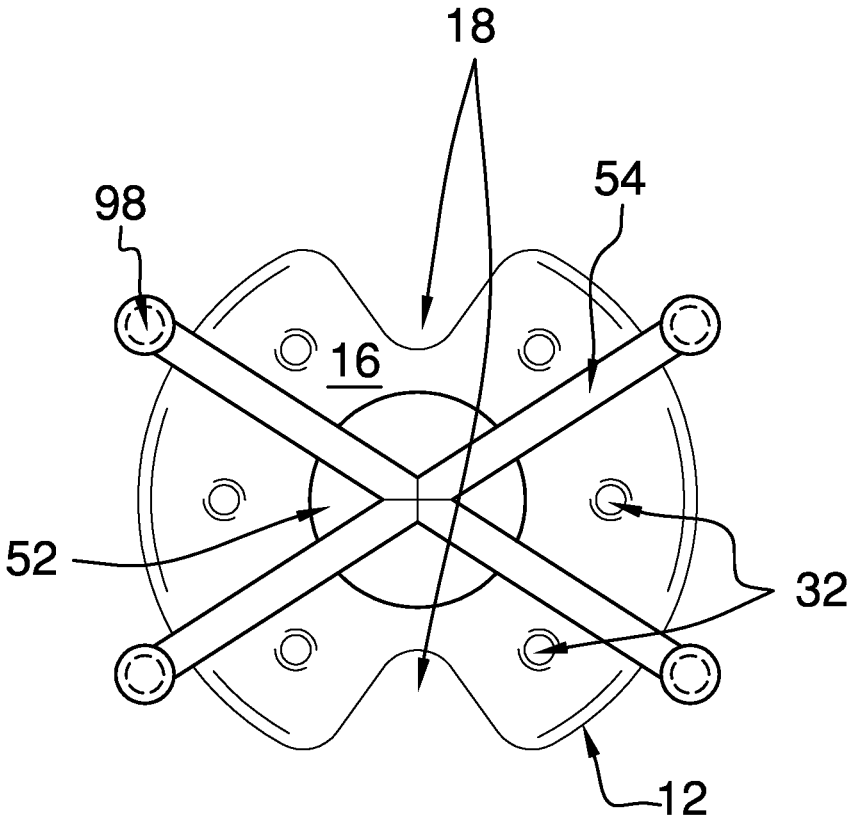
FIG. 4 is a bottom view of an embodiment of the disclosure.

As shown in FIG. 1, the plurality of legs 14 comprises four legs 14, although the present invention also anticipates the plurality of legs 14 comprising three, five, or six legs 14. Each leg 14 may comprise a plurality of nested sections 34 so that the leg 14 is selectively extensible. As shown in FIG. 2, the plurality of nested sections 34 comprises an upper section 36, which is selectively extensible from a lower section 38. The present invention also anticipates the lower section 38 being selectively extensible from the upper section 36.

A set of first fasteners 40 is attached to the upper sections 36 so that each upper section 36 has at least one first fastener 40. A set of second fasteners 42 is attached to the lower sections 38 so that each lower section 38 has at least one second fastener 42. The second fasteners 42 are complementary to the first fasteners 40 so that each second fastener 42 is positioned to selectively engage a respective first fastener 40 to fixedly adjust a length 44 of a respective leg 14, thereby facilitating leveling and height adjustment of the panel 12.

The second fastener 42 may comprise a plurality of holes 46 and the respective first fastener 40 may comprise a pin 48. The pin 48 is spring loaded so that the pin 48 is positioned to selectively extend through a respective hole 46 to fix the length 44 of a respective leg 14. The present invention also anticipates the set of first fasteners 40 and the set of second fasteners 42 comprising other fastening means known to those skilled in the art of extensible legs.

Each foot 98 of a plurality of feet 98 is attached to a respective leg 14 distal from the panel 12. The feet 98, which comprise rubber, silicone, elastomer, or the like, are resiliently compressible and thus are configured to frictionally engage the surface 26 of the bathing enclosure 28 to limit lateral movement of the plurality of legs 14. A pad 50 may be attached to the upper face 30 of the panel 12, with respective orifices 32 extending through the pad 50.

In a first configuration, as shown in FIGS. 1-4, the panel 12 is substantially circular. A swivel plate 52 is attached to and is positioned between the plurality of legs 14 and the panel 12. The panel 12 thus is rotatable relative to the plurality of legs 14. The cutouts 18 in the first configuration are substantially V-shaped, but somewhat arcuate distal from the front edge 20 and from the rear edge 22.

In the first configuration, each upper section 36 comprises an upper segment 54, which extends arcuately from a lower segment 56 so that the upper segments 54 of the upper sections 36 meet and are substantially X-shaped. The panel 12 is attached to the upper segments 54.

Figure 5:
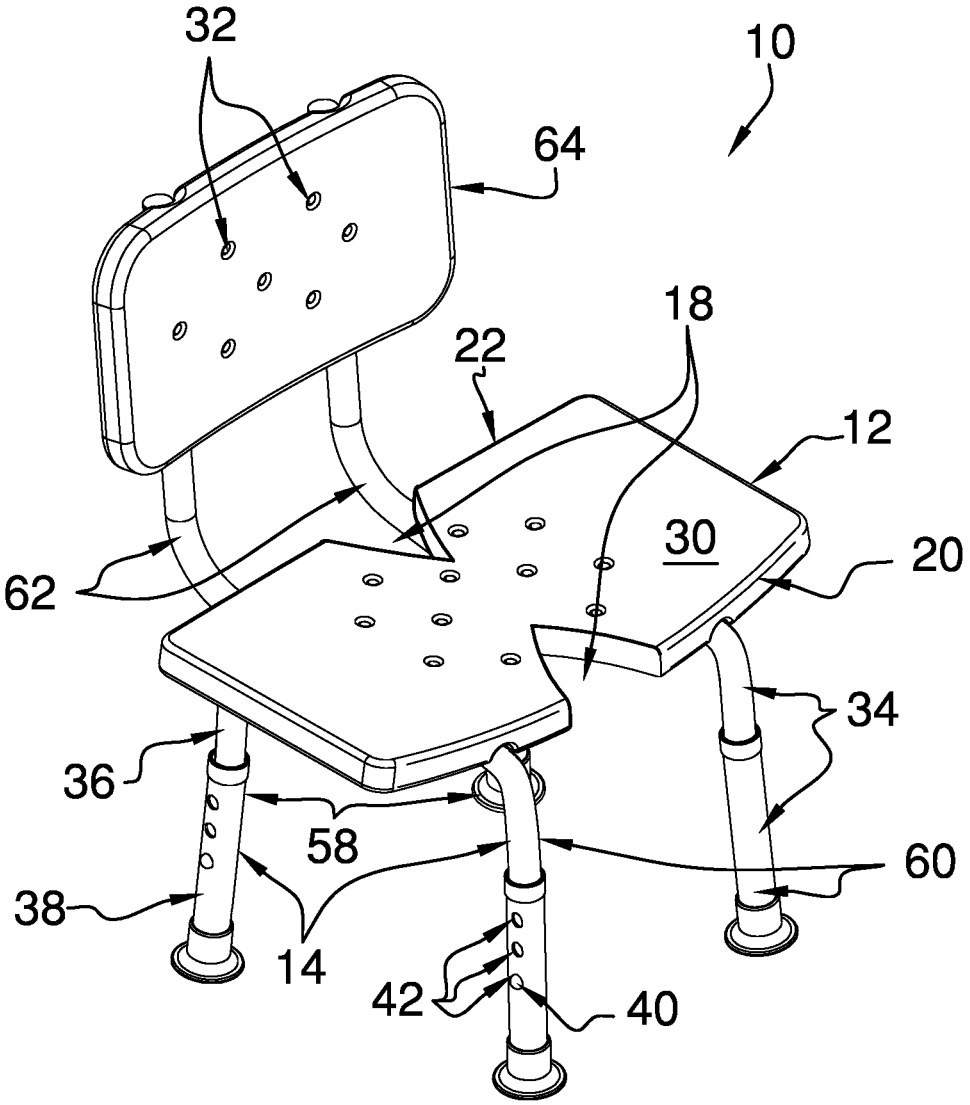
FIG. 5 is an isometric perspective view of an embodiment of the disclosure.
Figure 6:
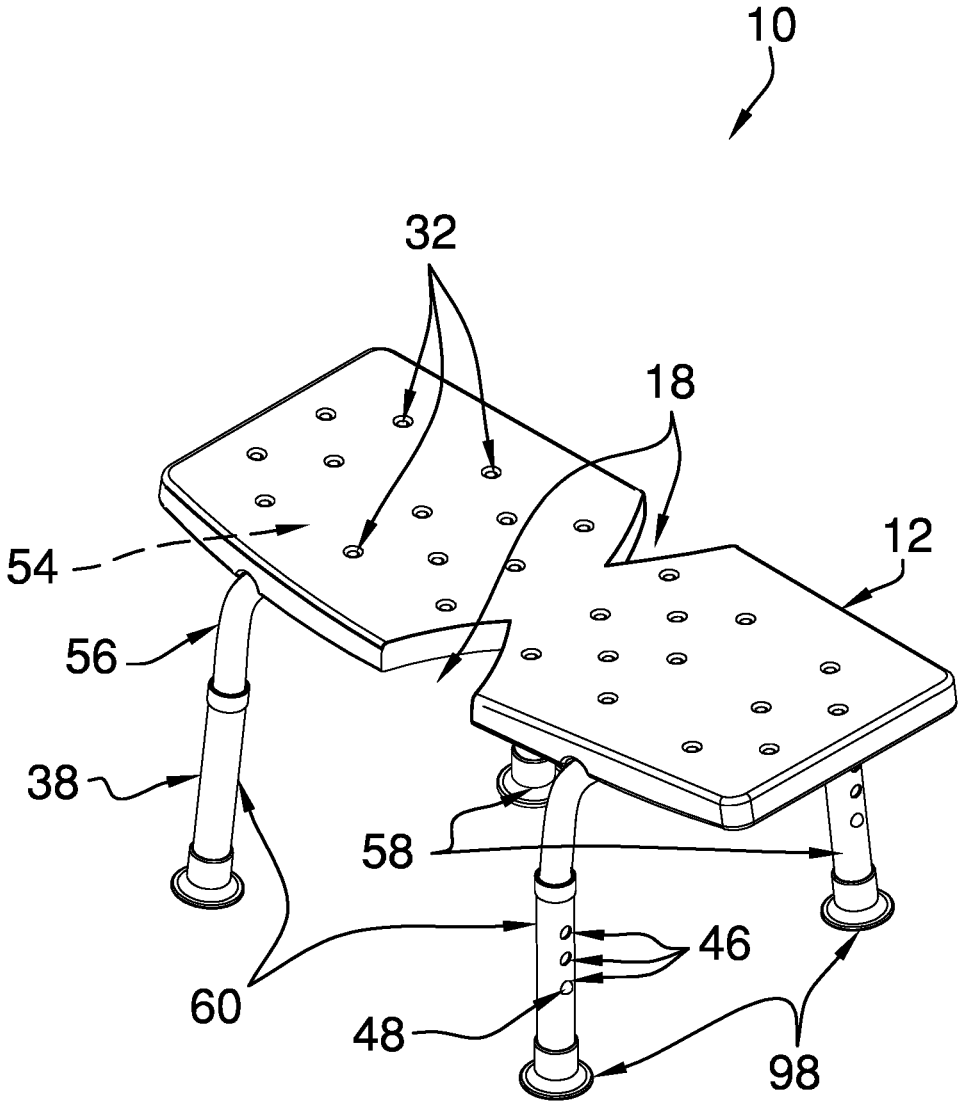
FIG. 6 is an isometric perspective view of an embodiment of the disclosure.
Figure 7:
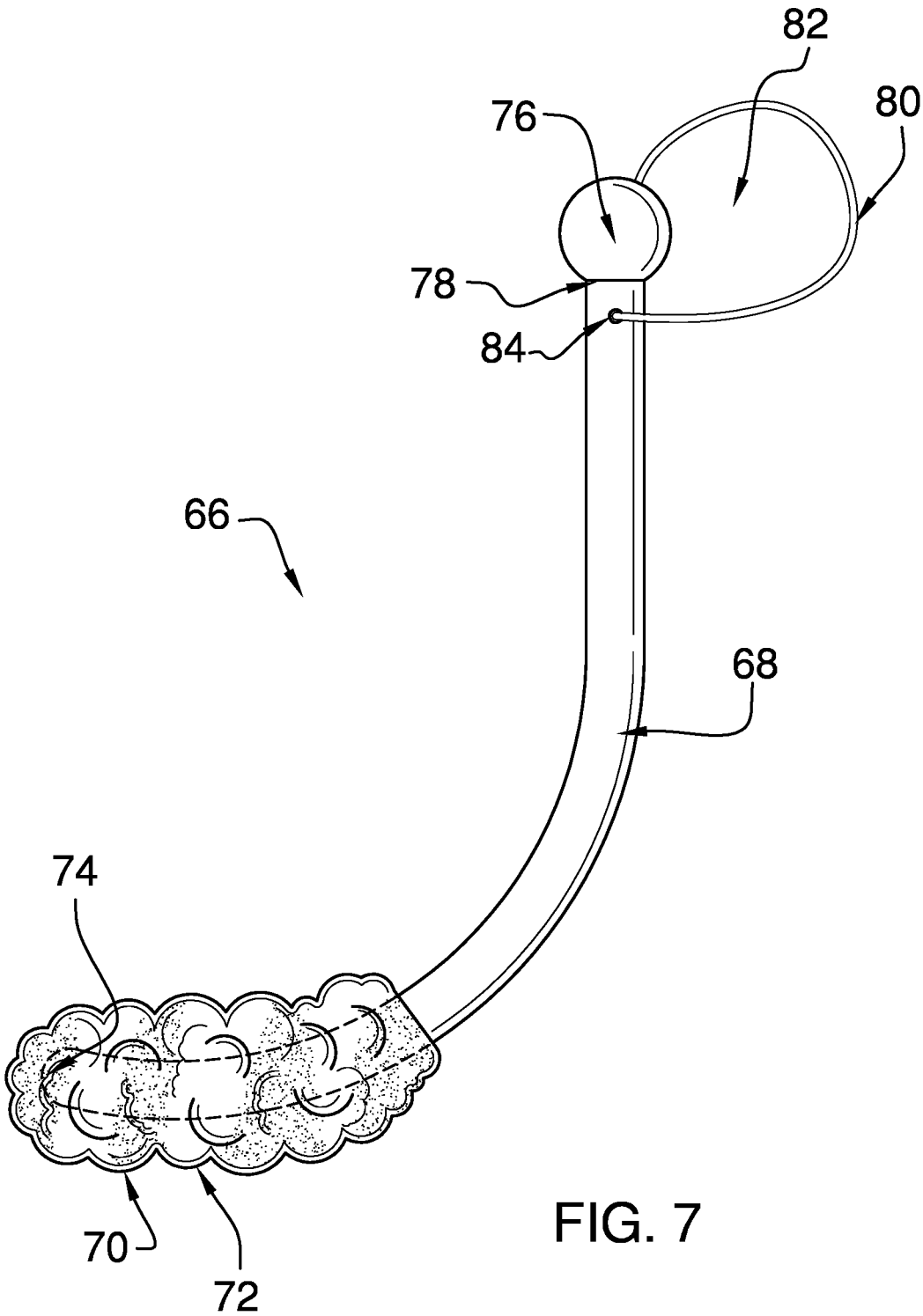
FIG. 7 is a side view of an embodiment of the disclosure.
Figure 8:
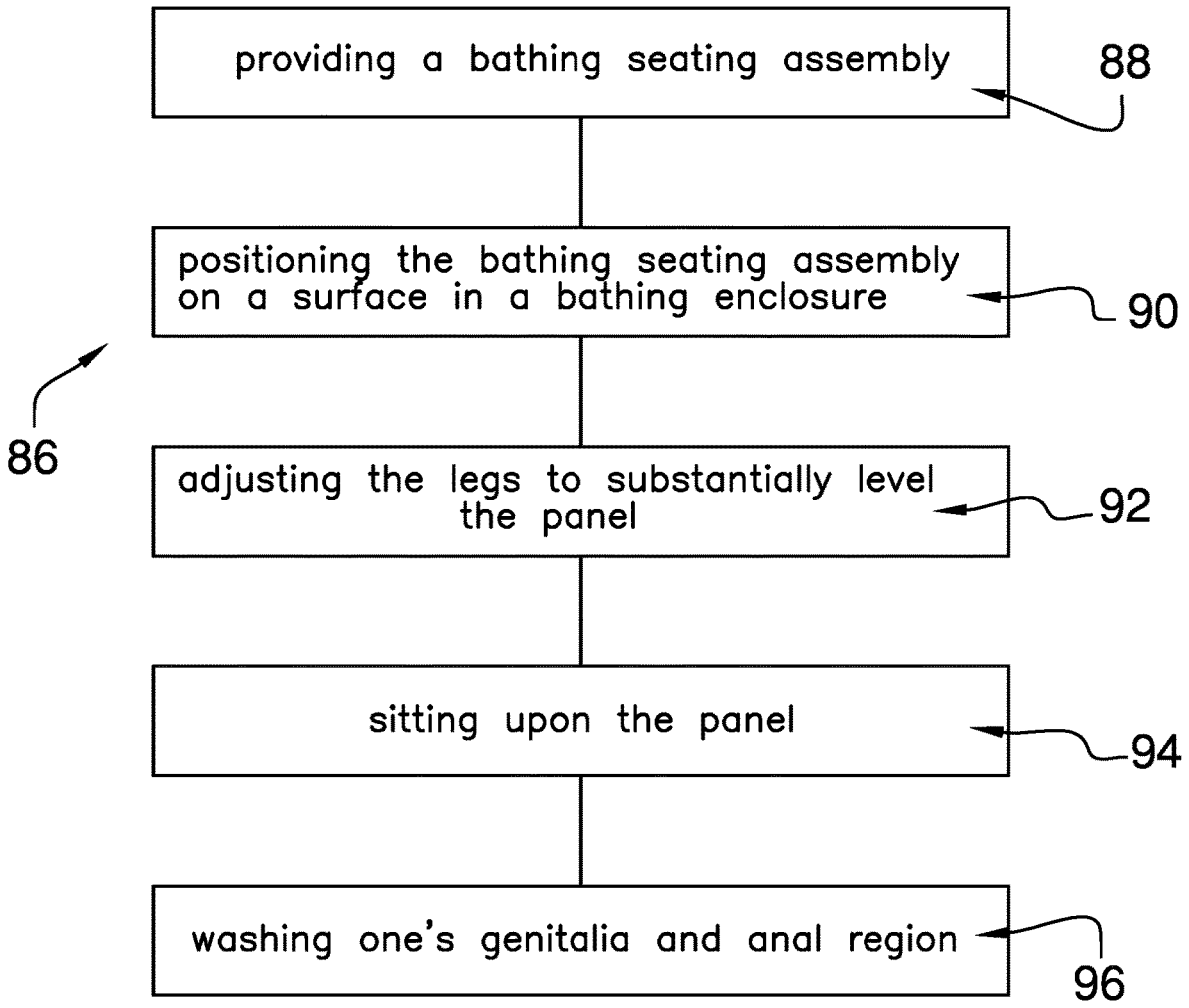
FIG. 8 is a flow diagram for a method utilizing an embodiment of the disclosure.

In a second configuration, as shown in FIGS. 5 and 6, the panel 12 is substantially rectangular. The cutout 18 extending into the rear edge 22 is bracketed by a rear pair 58 of the legs 14 and the cutout 18 extending into the front edge 20 is bracketed by a front pair 60 of the legs 14. The cutouts 18 in the second configuration are substantially V-shaped. Each upper section 36 of each leg 14 comprises an upper segment 54 that extend arcuately from a lower segment 56. The upper section 36 of a respective leg 14 of the rear pair 58 of the legs 14 is attached to and extends substantially linearly from the upper section 36 of an associated leg 14 of the front pair 60 of the legs 14. The panel 12 shown in FIG. 6 is elongated relative to that shown in FIG. 5.

As shown in FIG. 5, a pair of rods 62 may be attached to the plurality of legs 14 and extend arcuately and upwardly past the rear edge 22 of the panel 12. The rods 62 bracket the cutout 18 that extends into the rear edge 22. A backrest 64 is attached to and extend between the rods 62 distal from the panel 12. The backrest 64 is configured to support a back of the user seated upon the panel 12. Respective orifices 32 of the plurality of orifices 32 may be positioned in the backrest 64, which may be padded.

The bathing seating assembly 10 also may comprise a washing tool 66, which in turn comprises a wand 68, which is arcuate, and a washcloth 70, which is configured as a sleeve 72. A first end 74 of the wand 68 is insertable into the sleeve 72, which is selectively attachable to the wand 68. A handle 76 is attached to a second end 78 of the wand 68 and is configured to be grasped in a hand of the user, positioning the user to wash the genitalia by insertion of the washcloth 70 through the cutouts 18 positioned in the front edge 20 and the rear edge 22 of the panel 12, respectively. An endless string 80, which defines a loop 82, is positioned through a channel 84, which positioned in the wand 68 proximate to the second end 78. The loop 82 is configured for insertion of an element, such as a hook, faucet, or the like, that is attached to the bathing enclosure 28 to hang the wand 68.

In use, the bathing seating assembly 10 enables a method of bathing one's genitalia and anal region 86. The method 86 comprises a provision step 88, which entails providing a bathing seating assembly, as per the specification above. A first operational step 90 of the method 86 is positioning the bathing seating assembly on a surface 26 in a bathing enclosure 28. A second operational step 92 of the method 86 is adjusting the legs 14 to substantially level the panel 12. A first use step 94 of the method 86 is sitting upon the panel 12. A second use step 96 of the method 86 is washing one's genitalia and anal region.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathing seating assembly comprising:

a panel, the panel being substantially rigid;

a plurality of legs attached to and extending from a lower face of the panel;

a pair of cutouts positioned in the panel and extending singly into a front edge and a rear edge of the panel, each cutout being positioned substantially equally distant from opposed side edges of the panel, wherein the legs are configured for supporting the panel above a surface of a bathing enclosure, wherein an upper face of the panel is configured for seating of a user, such that genitalia and an anal region of the user are accessible for bathing via the cutouts in the front edge and the rear edge, respectively, each cutout tapering extending inwardly from the front edge and the rear edge respectively, the pair of cutouts being spaced from each other and aligned across the panel wherein said panel has a tapered medial portion extending between said pair of cutouts; and a plurality of orifices positioned in the panel, wherein the orifices are configured for draining water from the upper face.

2. The bathing seating assembly of claim 1, wherein the plurality of legs comprises four legs.

3. The bathing seating assembly of claim 1, wherein each leg comprises a plurality of nested sections, such that the leg is selectively extensible.

4. The bathing seating assembly of claim 3, wherein the plurality of nested sections comprises an upper section selectively extensible from a lower section.

5. The bathing seating assembly of claim 4, further including:

a set of first fasteners attached to the upper sections, such that each upper section has at least one first fastener; and a set of second fasteners attached to the lower sections, such that each lower section has at least one second fastener, the second fasteners being complementary to the first fasteners, such that each second fastener is positioned for selectively engaging a respective first fastener for fixedly adjusting a length of a respective leg.

6. The bathing seating assembly of claim 5, wherein the second fastener comprises a plurality of holes and the respective first fastener comprises a pin, the pin being spring loaded, such that the pin is positioned for selectively extending through a respective hole for fixing a length of a respective leg.

7. The bathing seating assembly of claim 1, further including a plurality of feet, each foot being attached to a respective leg distal from the panel, the feet being resiliently compressible, wherein the feet are configured for frictionally engaging the surface of the bathing enclosure for limiting lateral movement of the plurality of legs.

8. The bathing seating assembly of claim 7, wherein the feet comprise rubber, silicone, or elastomer.

9. The bathing seating assembly of claim 1, further including a pad attached to the upper face of the panel, respective orifices extending through the pad.

10. The bathing seating assembly of claim 1, further including:

the panel being substantially circular; and a swivel plate attached to and positioned between the plurality of legs and the panel, such that the panel is rotatable relative to the plurality of legs.

11. The bathing seating assembly of claim 10, further including:

each upper section comprising an upper segment extending arcuately from a lower segment, such that the upper segments of the upper sections meet and are substantially X-shaped; and the panel being attached to the upper segments.

12. The bathing seating assembly of claim 1, wherein the panel is substantially rectangular.

13. The bathing seating assembly of claim 12, wherein:

the cutout extending into the rear edge is bracketed by a rear pair of the legs;

the cutout extending into the front edge is bracketed by a front pair of the legs;

each upper section comprises an upper segment extending arcuately from a lower segment; and the upper section of a respective leg of the rear pair of the legs is attached to and extends substantially linearly from the upper section of an associated leg of the front pair of the legs.

14. The bathing seating assembly of claim 12, further including:

a pair of rods attached to the plurality of legs and extending arcuately and upwardly past the rear edge of the panel, such that the rods bracket the cutout extending into the rear edge; and a backrest attached to and extending between the rods distal from the panel, wherein the backrest is configured for supporting a back of the user seated upon the panel.

15. A bathing seating assembly comprising:

a panel, the panel being substantially rigid;

a plurality of legs attached to and extending from a lower face of the panel, the plurality of legs comprising four legs, each leg comprising an upper section selectively extensible from a lower section;

a set of first fasteners attached to the upper sections, such that each upper section has at least one first fastener;

a set of second fasteners attached to the lower sections, such that each lower section has at least one second fastener, the second fasteners being complementary to the first fasteners, such that each second fastener is positioned for selectively engaging a respective first fastener for fixedly adjusting a length of a respective leg, the second fastener comprising a plurality of holes, the respective first fastener comprising a pin, the pin being spring loaded, such that the pin is positioned for selectively extending through a respective hole for fixing a length of a respective leg;

a plurality of feet, each foot being attached to a respective leg distal from the panel, the feet being resiliently compressible, wherein the feet are configured for frictionally engaging a surface of a bathing enclosure for limiting lateral movement of the plurality of legs, the feet comprising rubber, silicone, or elastomer;

a pair of cutouts positioned in the panel and extending singly into a front edge and a rear edge of the panel, each cutout being positioned substantially equally distant from opposed side edges of the panel, wherein the legs are configured for supporting the panel above the surface of the bathing enclosure, wherein an upper face of the panel is configured for seating of a user, such that genitalia and an anal region of the user are accessible for bathing via the cutouts in the front edge and the rear edge, respectively, each cutout tapering extending inwardly from the front edge and the rear edge respectively, the pair of cutouts being spaced from each other and aligned across the panel wherein said panel has a tapered medial portion extending between said pair of cutouts;

a plurality of orifices positioned in the panel, wherein the orifices are configured for draining water from the upper face; and a pad attached to the upper face of the panel, respective orifices extending through the pad.

16. The bathing seating assembly of claim 15, further including:

the panel being substantially circular;

a swivel plate attached to and positioned between the plurality of legs and the panel, such that the panel is rotatable relative to the plurality of legs;

each upper section comprising an upper segment extending arcuately from a lower segment, such that the upper segments of the upper sections meet and are substantially X-shaped; and the panel being attached to the upper segments.

17. The bathing seating assembly of claim 15, wherein:

the panel is substantially rectangular;

the cutout extending into the rear edge is bracketed by a rear pair of the legs;

the cutout extending into the front edge is bracketed by a front pair of the legs;

each upper section comprises an upper segment extending arcuately from a lower segment; and the upper section of a respective leg of the rear pair of the legs is attached to and extends substantially linearly from the upper section of an associated leg of the front pair of the legs.

18. The bathing seating assembly of claim 17, further including:

a pair of rods attached to the plurality of legs and extending arcuately and upwardly past the rear edge of the panel, such that the rods bracket the cutout extending into the rear edge; and a backrest attached to and extending between the rods distal from the panel, wherein the backrest is configured for supporting a back of the user seated upon the panel.

19. The bathing seating assembly of claim 1, further including a washing tool comprising:

a wand, the wand being arcuate;

a washcloth, the washcloth being configured as a sleeve, such that a first end of the wand is insertable into the sleeve, the sleeve being selectively attachable to the wand;

a handle attached to a second end of the wand, wherein the handle is configured for grasping in a hand of the user, positioning the user for washing the genitalia by insertion of washcloth through the cutout positioned in the front edge of the panel and for washing the anal region by insertion of washcloth through the cutout positioned in the rear edge of the panel;

a channel positioned in the wand proximate to the second end; and an endless string positioned through the channel defining a loop, wherein the loop is configured for insertion of an element attached to the bathing enclosure for hanging the wand.

20. A method of bathing one's genitalia and anal region comprising the steps of:

providing a bathing seating assembly comprising:

a panel, the panel being substantially rigid, a plurality of legs attached to and extending from a lower face of the panel, a pair of cutouts positioned in the panel and extending singly into a front edge and a rear edge of the panel, each cutout being positioned substantially equally distant from opposed side edges of the panel, wherein the legs are configured for supporting the panel above a surface of a bathing enclosure, wherein an upper face of the panel is configured for seating of a user, such that genitalia and an anal region of the user are accessible for bathing via the cutouts in the front edge and the rear edge, respectively, each cutout tapering extending inwardly from the front edge and the rear edge respectively, the pair of cutouts being spaced from each other and aligned across the panel wherein said panel has a tapered medial portion extending between said pair of cutouts, and a plurality of orifices positioned in the panel, wherein the orifices are configured for draining water from the upper face;

positioning the bathing seating assembly on a surface in a bathing enclosure;

adjusting the legs to substantially level the panel;

sitting upon the panel; and washing one's genitalia and anal region.

* * * * *